US009943141B2

(12) United States Patent
Leung

(10) Patent No.: US 9,943,141 B2
(45) Date of Patent: Apr. 17, 2018

(54) CONVENIENT BUCKLE

(71) Applicant: Ching Fung Apparel Accessories Co. Ltd., Hong Kong (CN)

(72) Inventor: Kwok Yun Gary Leung, Hong Kong (CN)

(73) Assignee: Ching Fung Apparel Accessories Co. Ltd., Hong Kong (CN)

( * ) Notice: Subject to any disclaimer, the term of this patent is extended or adjusted under 35 U.S.C. 154(b) by 0 days.

(21) Appl. No.: 15/051,641

(22) Filed: Feb. 23, 2016

(65) Prior Publication Data

US 2016/0166015 A1 Jun. 16, 2016

(30) Foreign Application Priority Data

Jul. 21, 2015 (HK) ..... 15106956

(51) Int. Cl.
*A44B 11/25* (2006.01)
*A44B 11/26* (2006.01)

(52) U.S. Cl.
CPC ..... *A44B 11/2596* (2013.01); *A44B 11/2534* (2013.01); *A44B 11/263* (2013.01); *Y10T 24/45194* (2015.01)

(58) Field of Classification Search
CPC ..... A44B 11/2534; A44B 11/2596; A44B 11/263; A44B 11/2584; A44B 11/258; Y10T 24/45513; Y10T 24/45215; Y10T 24/45241; Y10T 24/45623; Y10T 24/4079; Y10T 24/45204; A44C 5/2085
See application file for complete search history.

(56) References Cited

U.S. PATENT DOCUMENTS

| | | | | |
|---|---|---|---|---|
| 4,307,494 | A | 12/1981 | Gasse | |
| 4,578,843 | A | 4/1986 | Lewis | |
| 6,694,578 | B1 | 2/2004 | Nicoll | |
| 8,857,019 | B1 * | 10/2014 | Nykoluk | A44B 11/2596 24/587.12 |
| 2004/0255439 | A1 | 12/2004 | Benedict | |
| 2011/0138583 | A1 * | 6/2011 | Fiedler | A44B 11/25 24/303 |

FOREIGN PATENT DOCUMENTS

| | | |
|---|---|---|
| CN | 2335419 | 9/1999 |
| CN | 201097705 | 8/2008 |
| CN | 102846104 | 1/2013 |
| FR | 1270392 | 8/1961 |
| GB | 2050485 | 1/1981 |
| GB | 2079359 | 1/1982 |

* cited by examiner

*Primary Examiner* — Robert Sandy
*Assistant Examiner* — Michael S Lee
(74) *Attorney, Agent, or Firm* — Eagle IP Limited; Jacqueline C. Lui

(57) ABSTRACT

A buckle for binding two items together that includes a male plate and a female plate. The male plate further includes a locking member that is movable between a locking position and an unlocking position, wherein the locking member in the locking position interacts with the locking mechanism to lock the male plate to the female plate along a longitudinal axis that is perpendicular to the binding axis. The female plate includes a locking mechanism that includes two arms extending from opposing ends of the female plate respectively and is adapted to slidably receive the male plate therewithin to secure the male plate face-to-face to the female plate along a binding axis.

5 Claims, 16 Drawing Sheets

CONVENIENT BUCKLE

FIELD OF INVENTION

This invention relates to a buckle, and in particular a belt buckle with an enhanced locking and releasing mechanism.

BACKGROUND OF INVENTION

A buckle, for example a belt buckle, is used for fastening two ends of straps or a belt, in which a device attached to one of the ends is fitted or coupled to the other. Belt buckles and other fixtures are used on a variety of belts.

Conventional buckles usually involve actions from the both hands before it can be released. It may sometimes impose a challenge to the user on releasing a buckle when one of the hands of the user is occupied with, say, holding bags.

SUMMARY OF INVENTION

In the light of the foregoing background, it is an object of the present invention to provide an alternate buckle with an improved locking and releasing mechanism that allows the user to more conveniently buckle and unlock the buckle.

Accordingly, the present invention, in one aspect, is a buckle for binding two items together that includes a male plate and a female plate. The male plate includes a first fastener disposed at a first end for connecting to a first item. The female plate includes a second fastener disposed at a first end for connecting to a first item. The male plate is adapted to couple to the female plate along the plane of the two plates with the first end of the male plate and the first end of the female plate in opposing sides to form a binding axis to bind the two items together.

The female plate further includes a locking mechanism comprising two arms extending from opposing ends of the female plate respectively and is adapted to slidably receive the male plate therewithin to secure the male plate face-to-face to the female plate along the binding axis. The male plate further includes a locking member that is movable between a locking position and an unlocking position, in which the locking member in the locking position interacts with the locking mechanism to lock the male plate to the female plate along a longitudinal axis perpendicular to the binding axis.

The locking member in a resting state is in the locking position such that when the male plate is coupled to the female plate, the male plate is stably locked into the locking position. The locking member is further movable by a simple pulling action to the unlocking position such that the male plate can be disengaged from the female plate along the binding axis and the longitudinal axis.

In an exemplary embodiment of the present invention, the locking member includes a tongue moveably disposed on the male plate, while the locking mechanism includes a tongue receiving port disposed on one of the arms adapted to receive the tongue therewithin, such that the male plate is secured to the female plate along the longitudinal axis.

According to another aspect of the present invention, a buckle for binding two items together is provided, which includes a male plate and a female plate. The male plate includes a first fastener disposed at a first end of the male plate for connecting to a first item; and a tongue member comprising a tongue disposed on a first end of the tongue member and adapted to be movable between a locking position and an unlocking position.

The female plate includes a second fastener disposed at a first end of the female plate for connecting to a second item; a hook arm extending from the first end of the female plate and disposed on a base; and a flange arm extending from a second end of the female plate and disposed on the base.

The male plate is adapted to couple to the female plate along the plane of the two plates with the first end of the male plate and the first end of the female plate in opposing sides to form a binding axis to bind the two items together.

The flange arm and the hook arm of the female plate area are adapted to slidably receive the male plate therewithin to secure the male plate face-to-face to the female plate along the binding axis.

The tongue in the locking position interacts with the hook arm to lock the male plate to the female plate along a longitudinal axis perpendicular to the binding axis. As such, when the male plate is coupled to the female plate, the male plate is stabling locked into the locking position. The tongue is further movable by a simple pulling action to the unlocking position such that the male plate can be disengaged from the female plate along the binding axis and the longitudinal axis.

In an exemplary embodiment of the present invention, the hook arm includes a tongue receiving port disposed on the hook arm, while the tongue receiving port is adapted to receive the tongue therewithin. As such, the male plate is secured to the female plate along the longitudinal axis.

Due to the novel design of the locking mechanism within the buckle, it is more convenient for the user to smoothly fasten or release the buckle. This will be extremely helpful when one of the hands of the user is occupied so that such fastening or releasing action can be done by a simple single-handed action.

DETAILED DESCRIPTION OF THE PREFERRED EMBODIMENTS

As used herein and in the claims, "comprising" means including the following elements but not excluding others.

As used herein and in the claims, "a binding axis" refers to an axis formed by a first end of a male plate of this invention and a first end of a female plate of this invention in opposing sides, in which the first end of the male plate includes a first fastener disposed therein for connecting to a first item; and the first end of the female plate includes a second fastener disposed therein for connecting to a second item. In one embodiment, the first item and the second item refer to the two ends of a strap or a belt.

As used herein and in the claims, "a longitudinal axis" refers to an axis perpendicular to and on the same plane as the binding axis. As used herein and in the claims, "a transverse axis" refers to an axis perpendicular to both the binding axis and the longitudinal axis, and in a direction out of the plane formed by the binding axis and longitudinal axis.

Figure 1A:
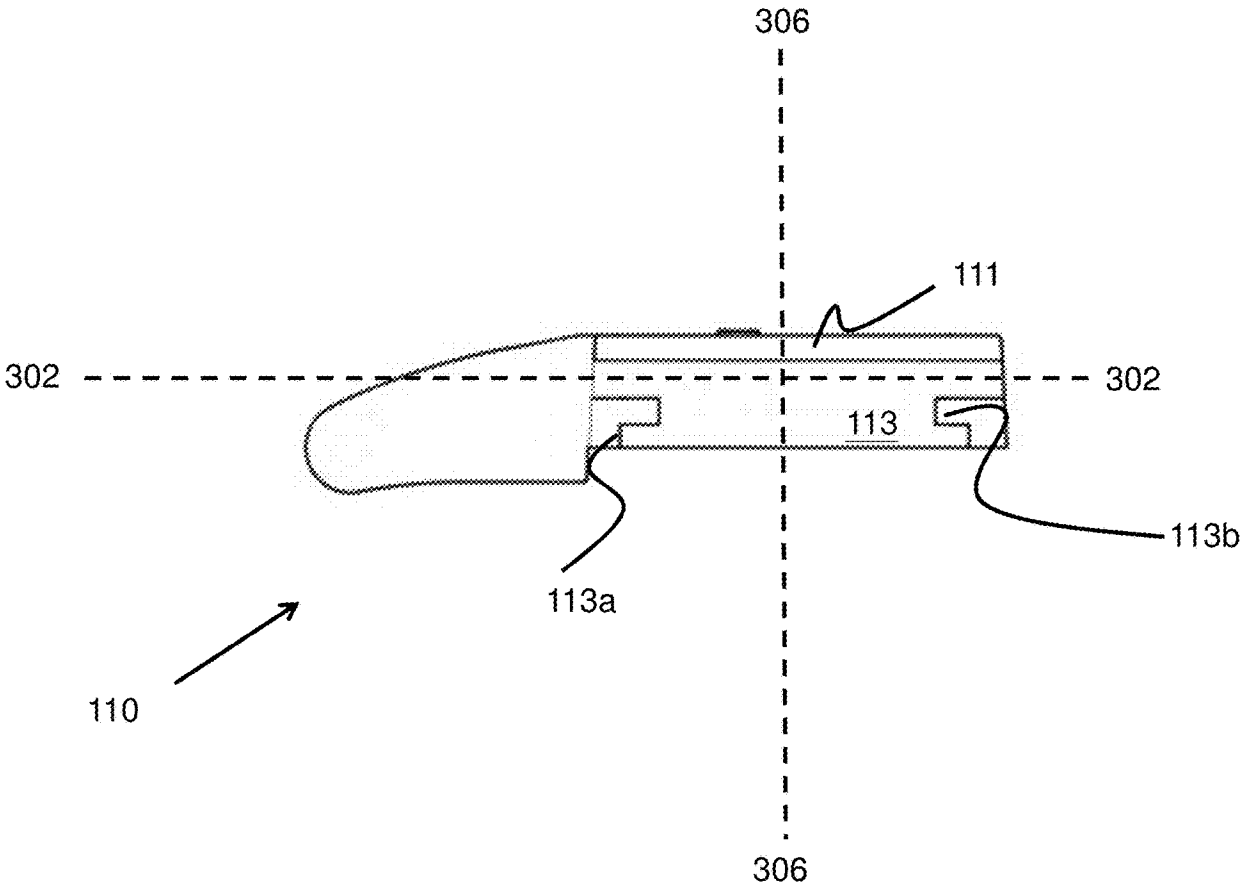
FIGS. 1A and 1B respectively illustrate a side view along the binding axis and a top perspective view of an engagement member of a male plate of the buckle according to one embodiment of the instant invention.
Figure 1B:
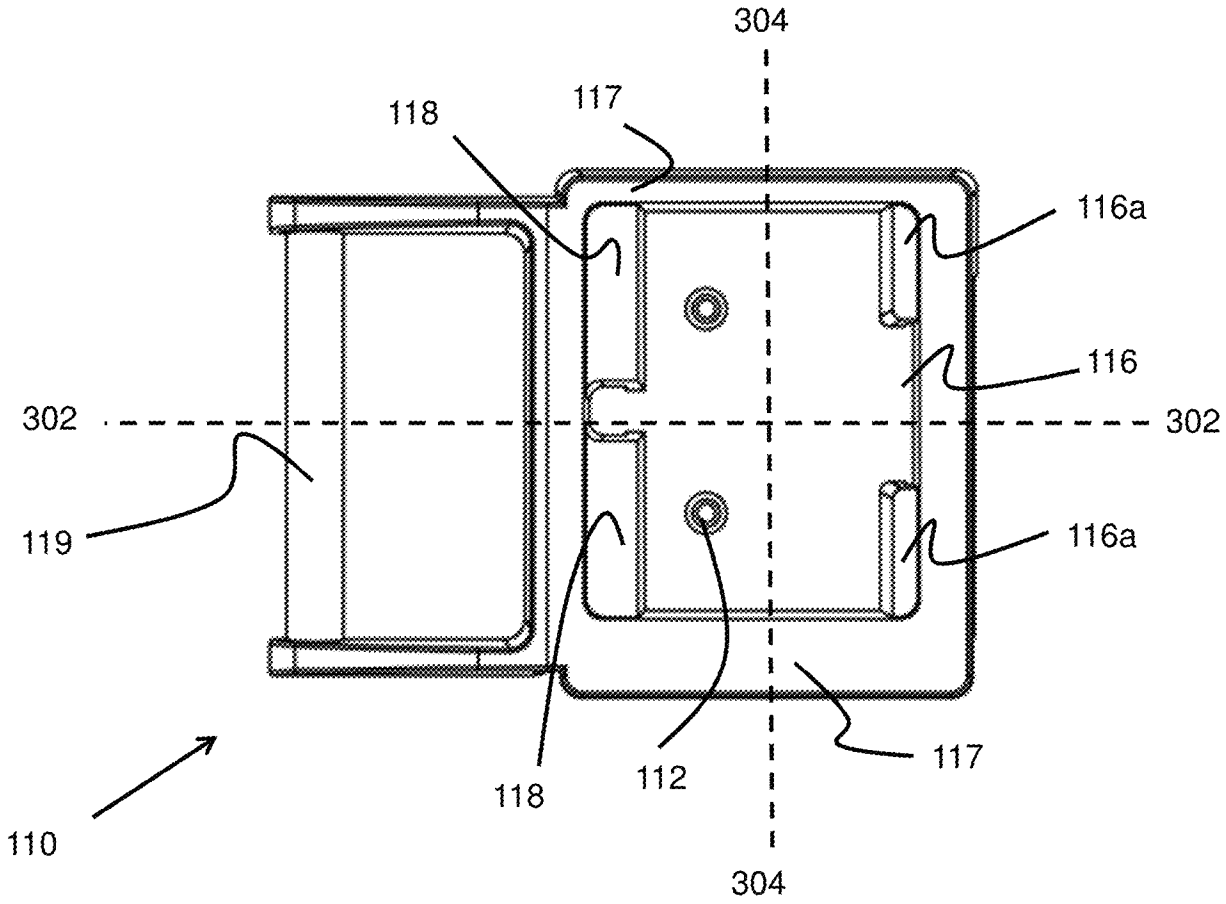

The first embodiment of the buckle of the present invention includes a male plate 100 that is composed of different members as shown in FIGS. 1A to 4B. First, the engagement member 110 of the male plate 100, as shown in FIGS. 1A and 1B, includes a first fastener 119 at a first end along a binding axis (dotted line 302), which connects to a housing 111 at a second end along the binding axis 302. A rail 113, abutting against the housing 111 along a transverse axis (dotted line 306), includes a flange 113*a* and a web 113*b* that connects the flange 113*a* and the housing 111.

Two tongue opening sidewalls 116*a* are disposed on the second end of the housing 111 along the binding axis 302. A tongue opening 116 is sandwiched between the two tongue opening sidewalls 116*a*. Two spring sidewalls 118 are disposed on the end of the housing 111 connecting to the first fastener 119 along the binding axis. Thus, the two tongue opening sidewalls 116*a*, the two spring sidewalls 118, and two housing sidewalls 117 respectively disposed on each end of the housing 111 along a longitudinal axis 304 creates a housing cavity within the housing 111. At least one spring (not show in FIG. 1A or 1B) is disposed within the housing cavity and abuts against each of the spring sidewalls 118. At least one cylindrically shaped pillar 112 is disposed within the housing cavity.

Figure 2A:
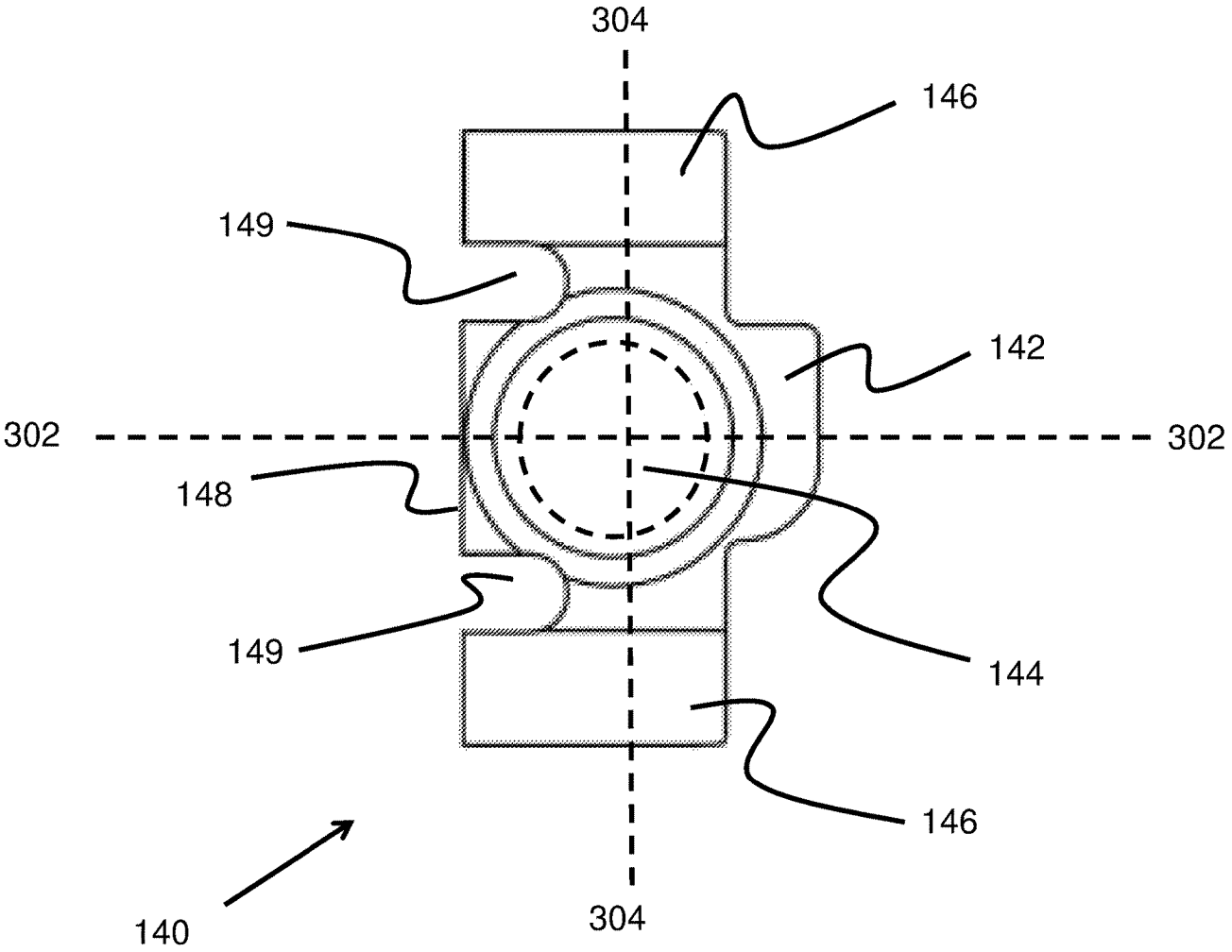
FIGS. 2A and 2B respectively illustrate a top view of a tongue member of the male plate and a side view along the longitudinal axis of the tongue member of the male plate according to the same embodiment of the instant invention.
Figure 2B:
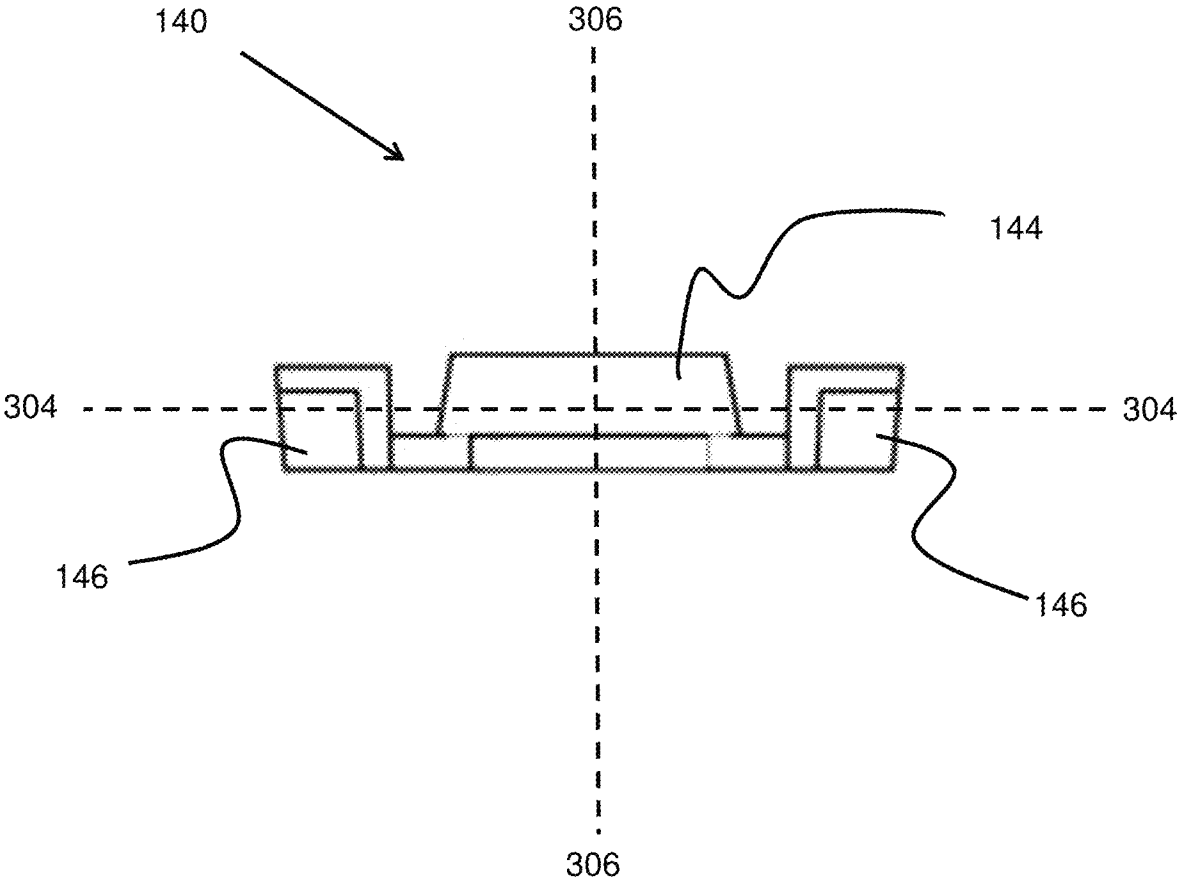

Next, as shown in FIGS. 2A and 2B, a second member of the male plate 100, a tongue member 140, includes a washer holder 144 disposed at the center of the tongue member 140, a flat end 148 disposed on the first end along the binding axis 302 and a trapezoidal shaped tongue 142 disposed on the second end along the binding axis 302. A washer (not shown in FIG. 2A or 2B) is further provided to be adapted to be fittingly disposed within the washer holder 144. The tongue member 140 includes a spring support 146 disposed on each end along the longitudinal axis 304. Further, at least one pillar port 149 is disposed between the spring support 146 and the washer holder 144 along the longitudinal axis 304. The spring (not shown in FIG. 2A or 2B) is resiliently sandwiched between the spring support 146 and the spring sidewall 118 of the engagement member 110.

Figure 3:
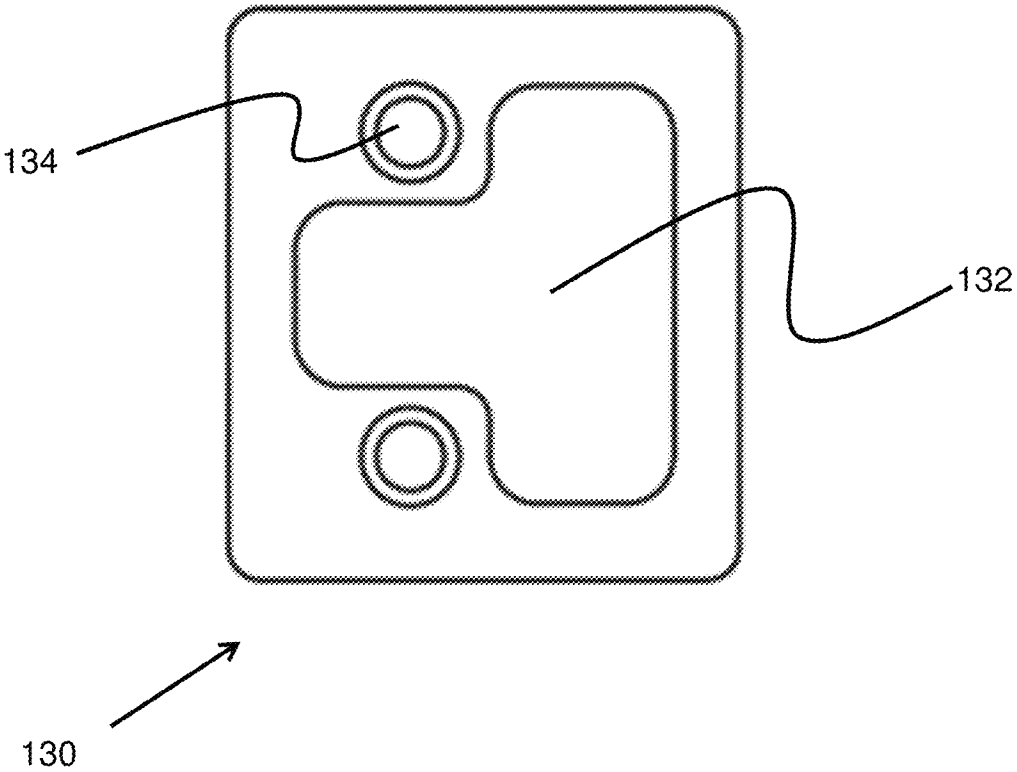
FIG. 3 illustrates a top view of a support plate member of the male plate according to the same embodiment of the instant invention.

As shown in FIG. 3, the male plate 100 further includes a third member, a support member 130. The support member 130 includes a T-shaped opening 132 at the center and at least one pillar opening 134.

Figure 4A:
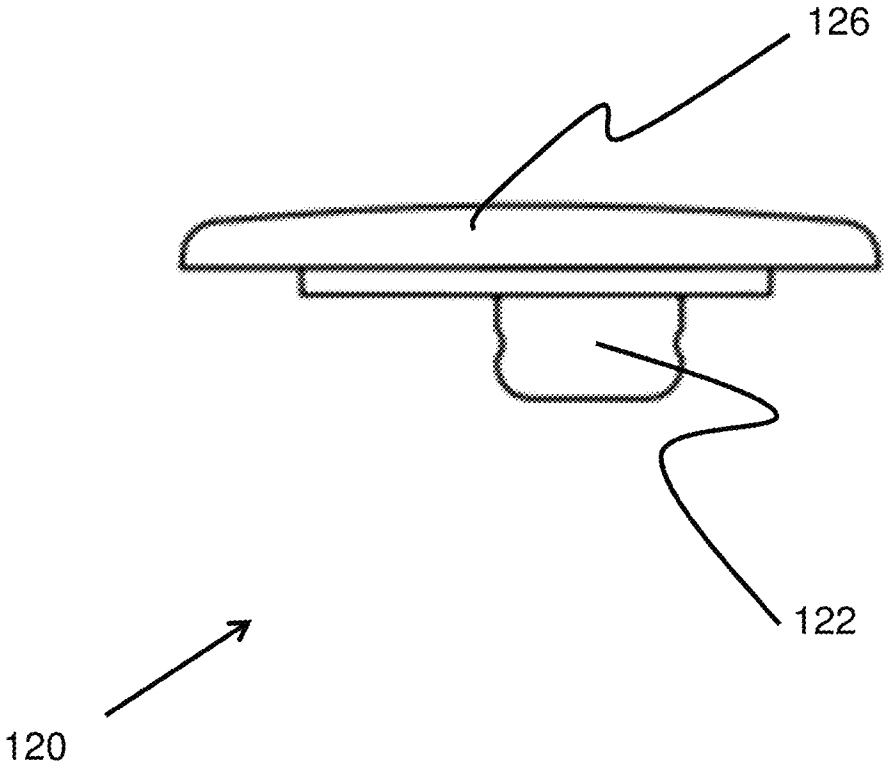
FIGS. 4A and 4B respectively illustrate a side view along the binding axis and a top view of a press member of the male plate according to the same embodiment of the instant invention.
Figure 4B:
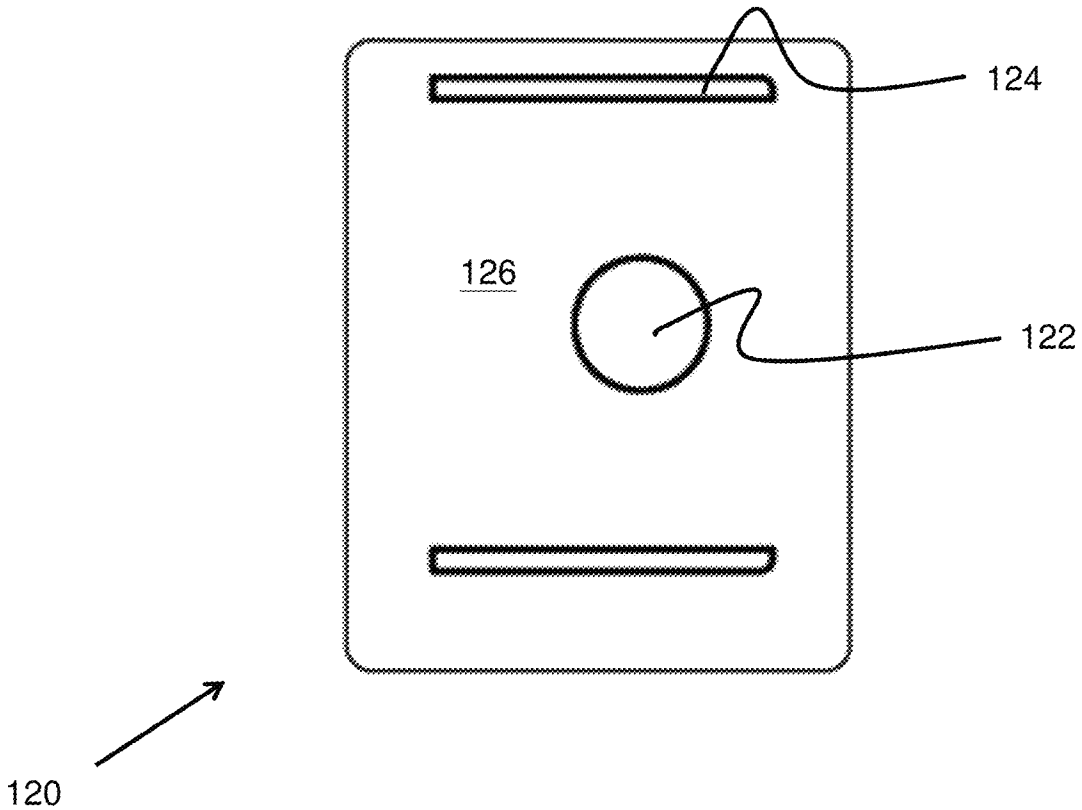

A fourth member of the male plate 100, a press member 120, is shown in FIGS. 4A and 4B. The press member 120 includes a press plate 126 on which a press protrusion 122 is disposed. At least one press rail 124 is disposed on each end along the longitudinal axis 304 of the press plate 126.

Figure 5A:
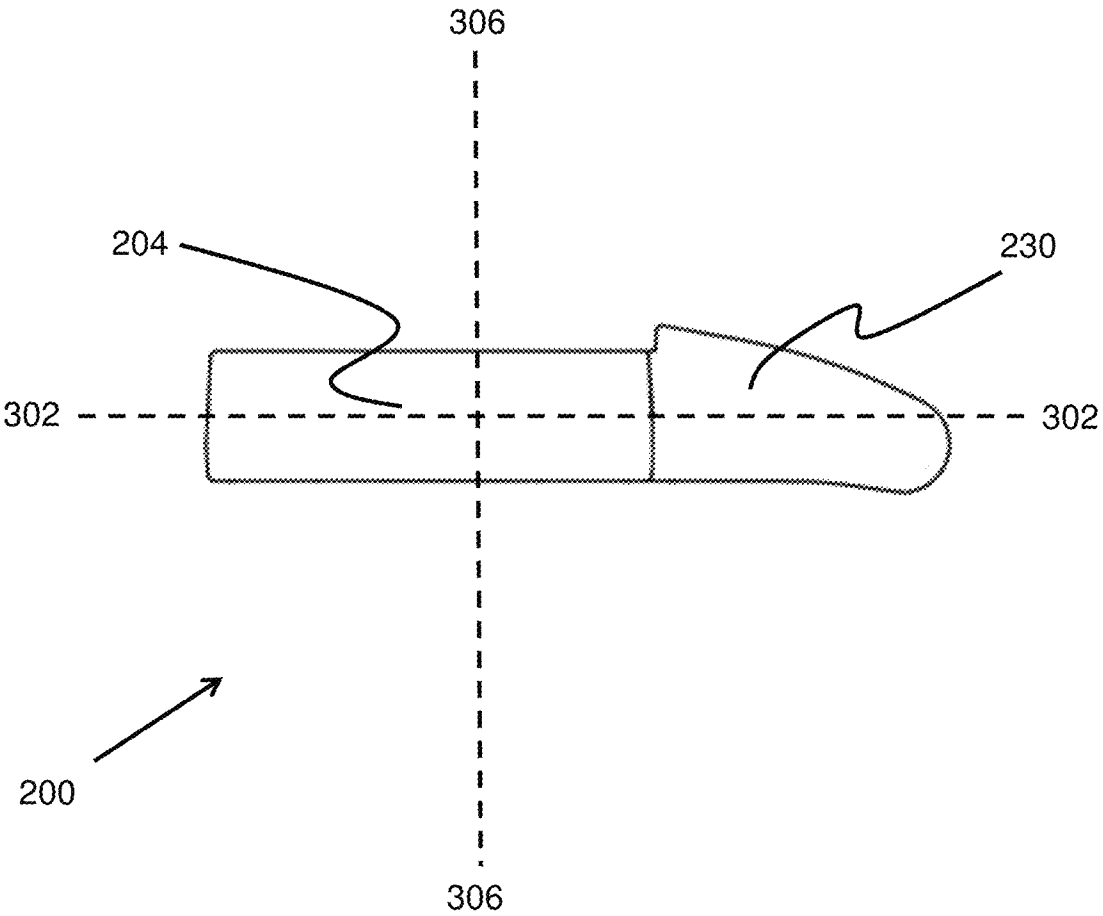
FIGS. 5A and 5B respectively illustrate a side view along the binding axis and a top view of a female plate of the buckle according to the same embodiment of the instant invention.
Figure 5B:
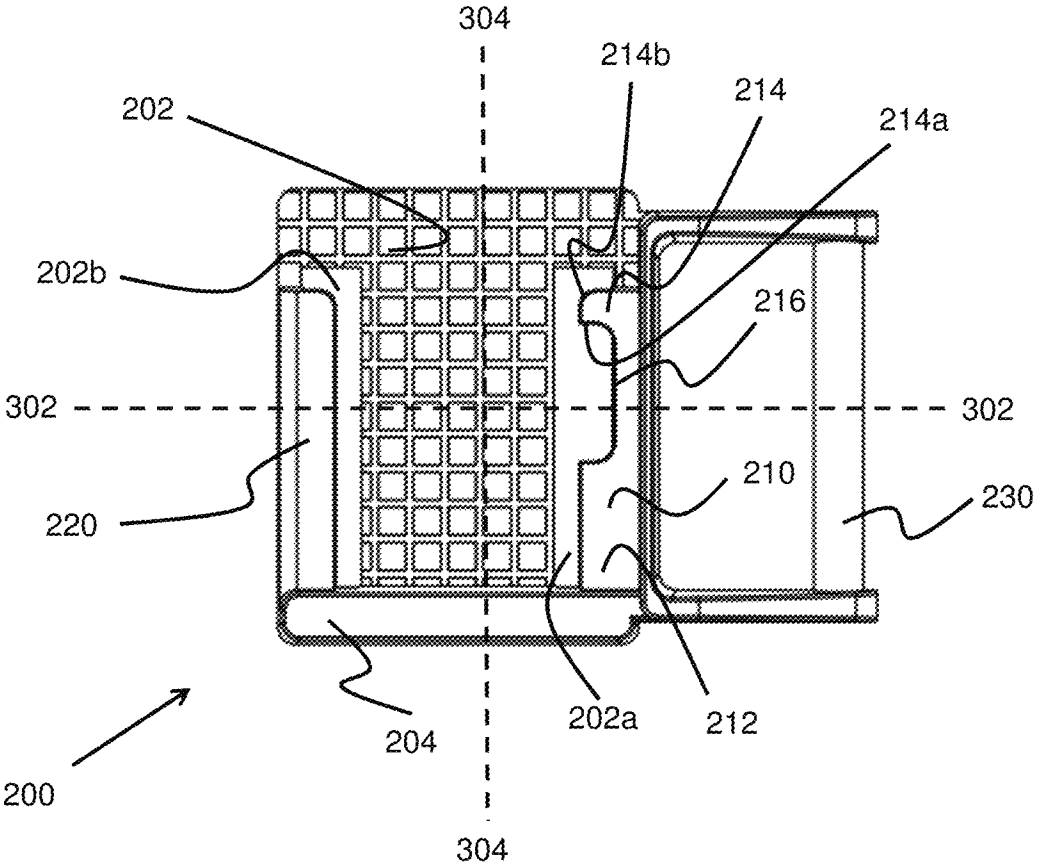

Now referring to FIGS. 5A and 5B, a female plate 200 of the buckle of the same embodiment of the present invention is shown. The female plate 200 includes a base 202 with 3 enclosed sides (sidewall 204, hook arm 210 and flange arm 220) and a fourth open side on a first end along the longitudinal axis 304. The sidewall 204 is disposed on a second end along the longitudinal axis of the base 202. The flange arm 220 and the hook arm 210 are respectively disposed on the first end and the second end along the binding axis 302 of the base 202. A second fastener 230 is disposed on the second end along the binding axis 302 and abuts against the hook arm 210. Consequently, the second fastener 230 (together with the hook arm 210), the side wall 204 and the flange arm 220 creates a cavity on the base 202.

The hook arm 210 includes a hook rim 212 abutting against the sidewall 204 and a hook 214 disposing on the opposite end of the hook arm 210 along the longitudinal axis 304. A tongue receiving port 216 is sandwiched between the hook rim 212 and the hook 214. The hook 214 further includes a locking portion 214*a* forming a side of the tongue receiving port 216 and a slant portion 214*b*. A first opening 202*a* is provided between the hook arm 210 and the base 202, while a second opening 202*b* is provided between the flange arm 220 and the base 202.

Assembly of the Male Plate

Figure 8:
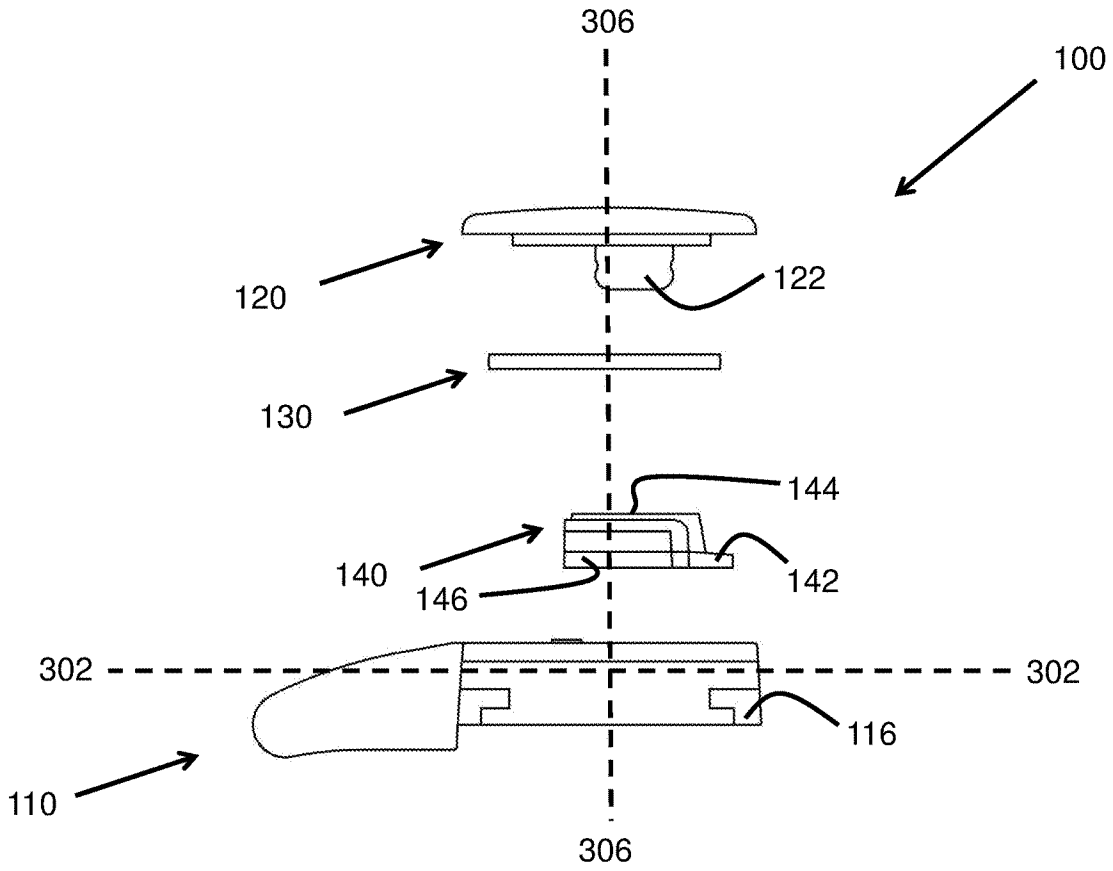
FIG. 8 illustrates a manner in which different members of a male plate are assembled into the male plate according to one embodiment of the instant invention.

The following paragraphs, as shown in FIG. 8, describe the assembly of the different members of the male plate 100. The tongue member 140 is first disposed within the housing cavity of the housing 111 (not shown in FIG. 8) of the engagement member 110. When the tongue member 140 approaches the first end along the binding axis, the pillar ports 149 (not shown in FIG. 8) receive the pillars 112 (not shown in FIG. 8); while when the tongue member 140 approaches the second end along the binding axis within the housing cavity, the tongue 142 is adapted to extend through the tongue opening 116. Further, the movement of the tongue member 140 is facilitated by the resilient action of the spring disposed between the spring sidewall 118 (not shown in FIG. 8) of the engagement member 110 and the spring support 146 of the tongue member 140. As such, the tongue member 140 can be movably disposed within the housing cavity. In one embodiment, the tongue member 140 is movable along the binding axis 302 within the housing cavity.

Then, the support member 130 is disposed on top of the tongue member 140 along the transverse axis 306 and secured to the engagement member 110 through the coupling between the pillar openings 134 (not shown in FIG. 8) of the support member 130 and the pillars 112 (not shown in FIG. 8) of the engagement member 110. Lastly, the press member 120 is disposed on top of the support member 130 along the transverse axis 306 and coupled to the tongue member 140 through the insertion of the press protrusion 122 of the press member 120, via the T-shaped opening 132 (not shown in FIG. 8) of the support member 130, into the washer holder 144 of the tongue member 140. The washer disposed within the washer holder 144 provides additional and secure support to the press protrusion 122 on its insertion into the washer holder 144, thus enhancing the coupling of the press member 120 to the tongue member 140. As such, the male plate 100 of the instant invention is fully and securely assembled.

Operation of the Buckle

Figures 6A, 6B:
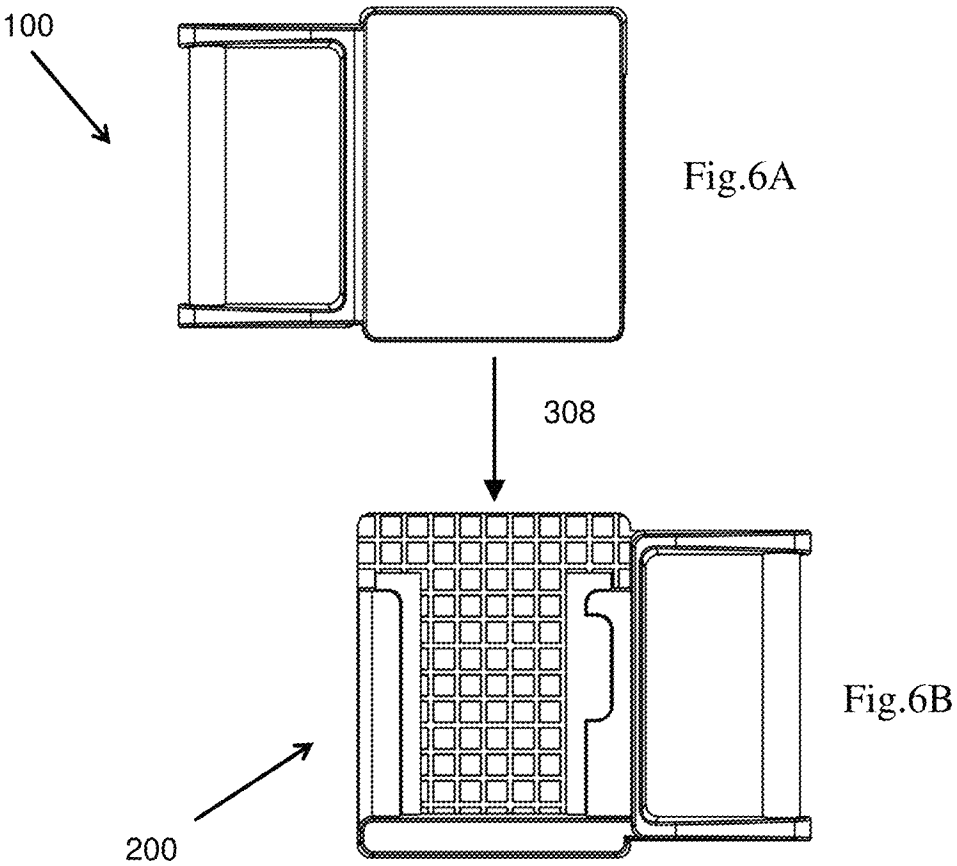
FIGS. 6A and 6B respectively illustrate a top perspective view of the (assembled) male plate and female plate of the buckle according to same embodiment of the instant invention where the male plate is coupled to the female plate.

The following paragraphs describe the operation of the buckle according to the same embodiment of the instant invention. First, an assembled male plate 100 and a female plate 200 are shown in FIGS. 6A and 6B. In coupling the male plate 100 with the female plate 200, a user first slid the male plate 100 into the female plate 200 along the direction 308 (i.e along the longitudinal axis 304). Then, the first opening 202*a* and the second opening 202*b*, the outlines thereof being complementary to the contour of the rail 113 of the engagement member 110, receive the flange 113*a* of the rail 113 therewithin, such that the male plate 100 is secured to the female plate 200 along both the binding axis 302 and the traverse axis 306.

Figure 7A:
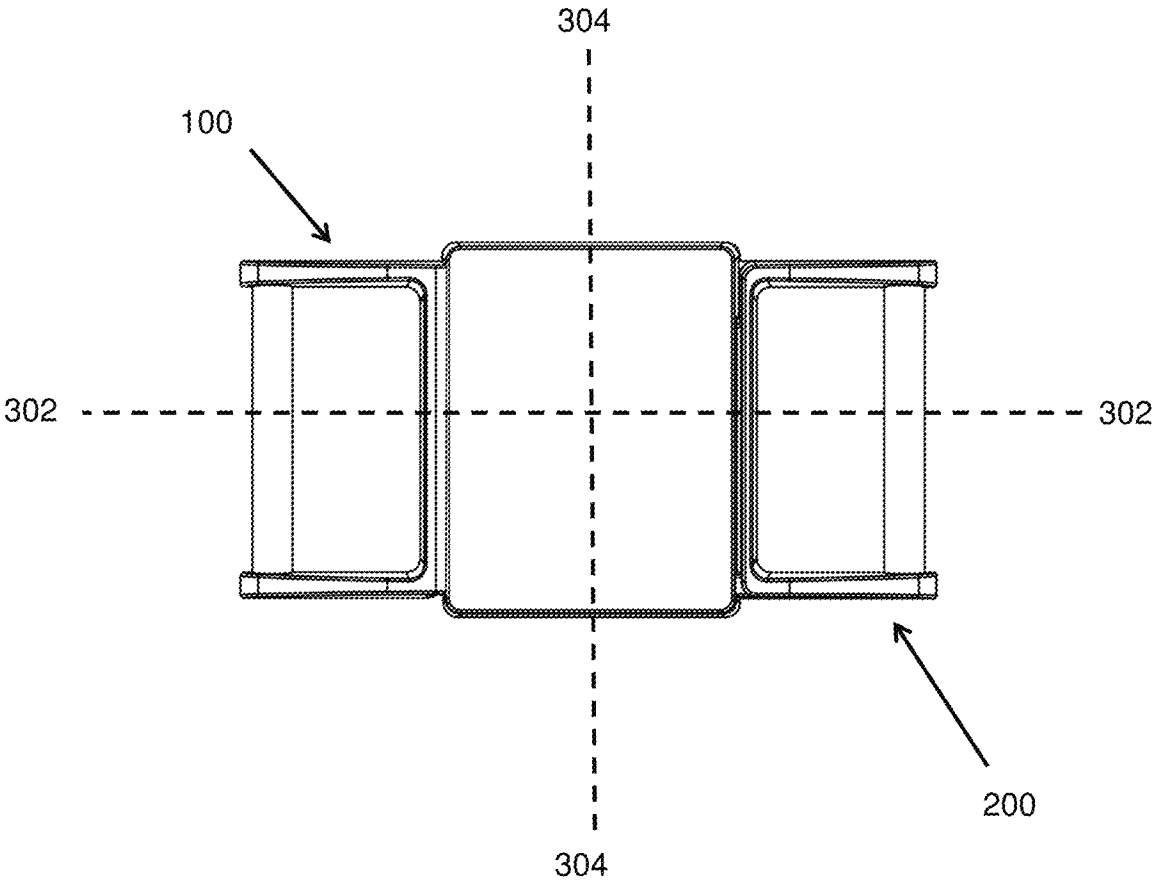
FIGS. 7A and 7B respectively illustrate a top perspective view and a side view along the binding axis of the buckle according to same embodiment of the instant invention where the male plate is coupled to the female plate.
Figure 7B:
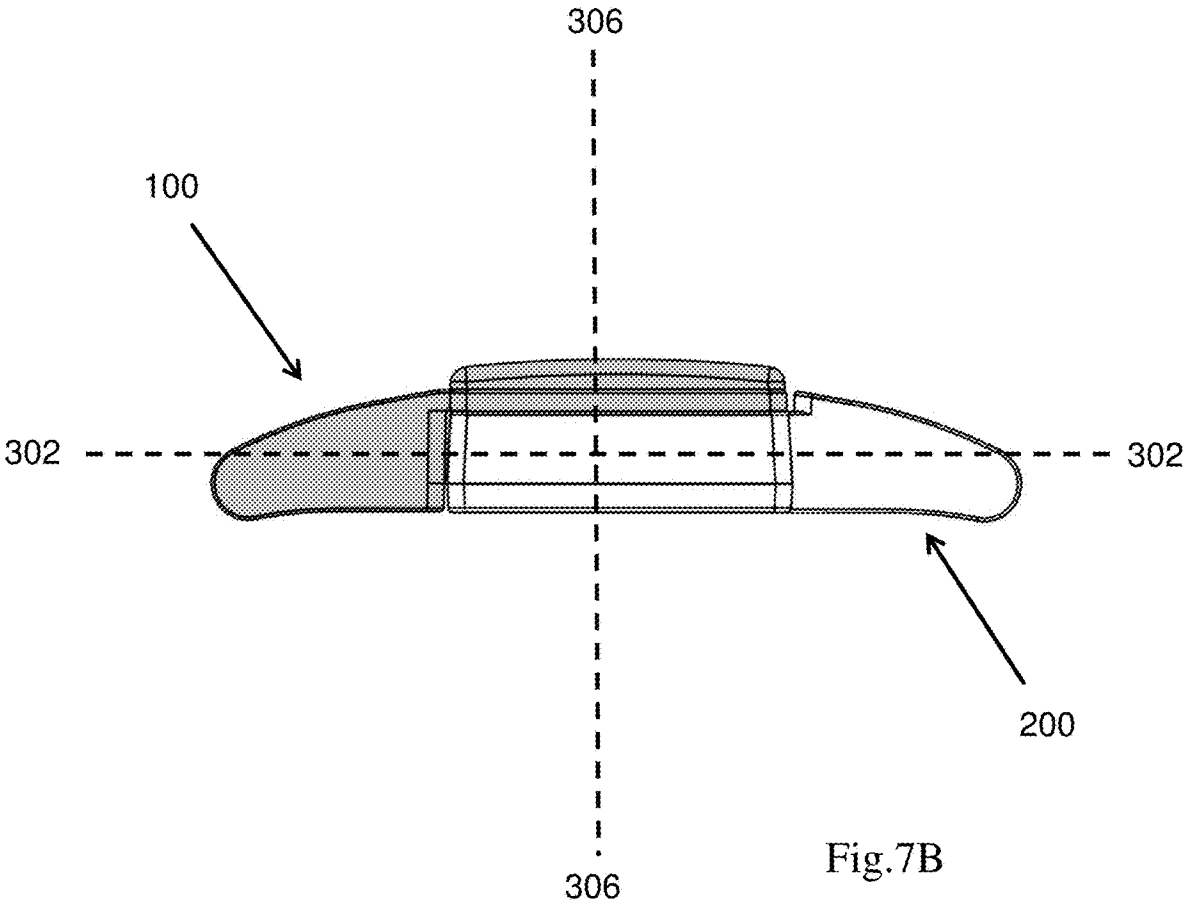

Meanwhile, the tongue 142 of the male plate 100 approaches the hook arm 210 of the female plate 200. Since the slant end of the tongue 142 is complementary to the slant portion 214*b* of the hook 214, the tongue 142 can smoothly engage with the slant portion 214*b* to swiftly enter the tongue receiving port 216 and be locked therewithin in a locking position. As such, the male plate 100 enters into a locking position (as shown in FIGS. 7A and 7B, where the male plate 100 is in light grey for ease of illustration) in which it is stabling locked with the female plate 200 along all of the three aforesaid axes.

Figure 9A:
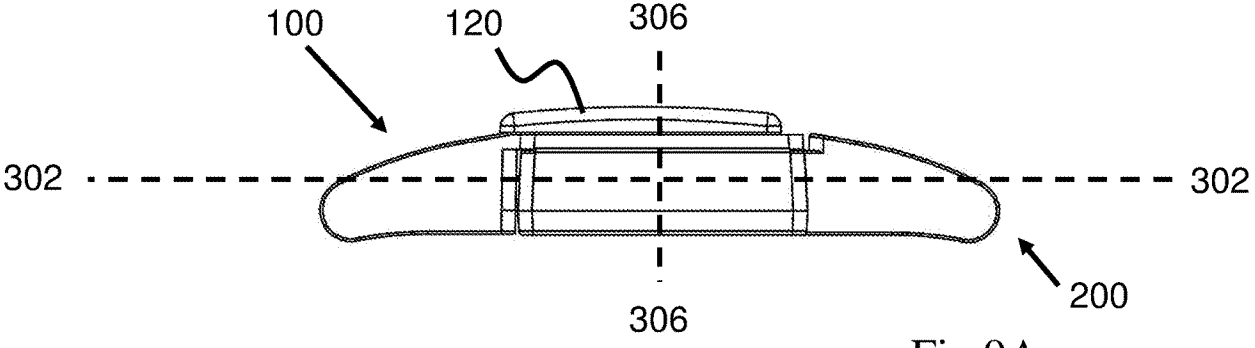
FIGS. 9A and 9B illustrate a side view along the binding axis of the buckle in unlocking position and locking position respectively according to one embodiment of the instant invention.
Figure 9B:
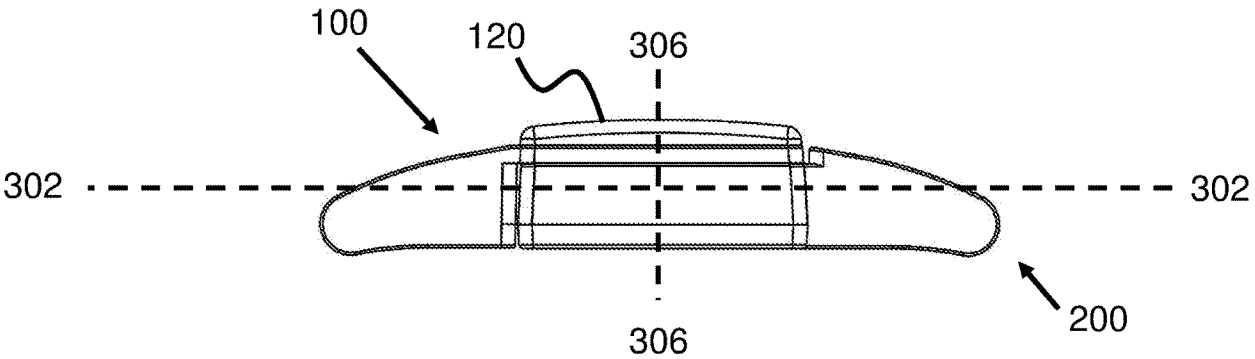
Figure 10A:
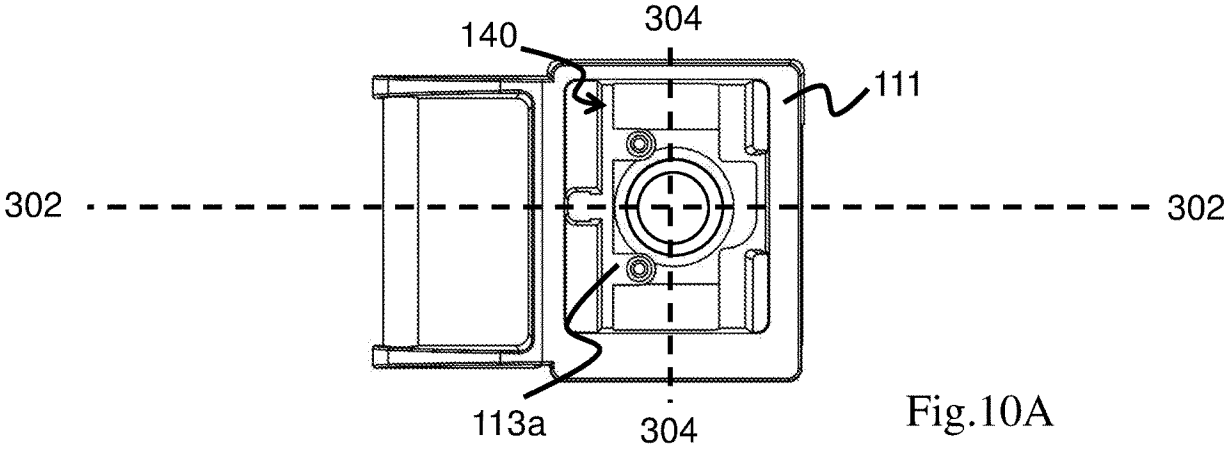
FIGS. 10A and 10B illustrate a top view of the tongue member coupled with the engagement member of the male plate of the buckle along the binding axis of the buckle in unlocking position and locking position respectively according to one embodiment of the instant invention.
Figure 10B:
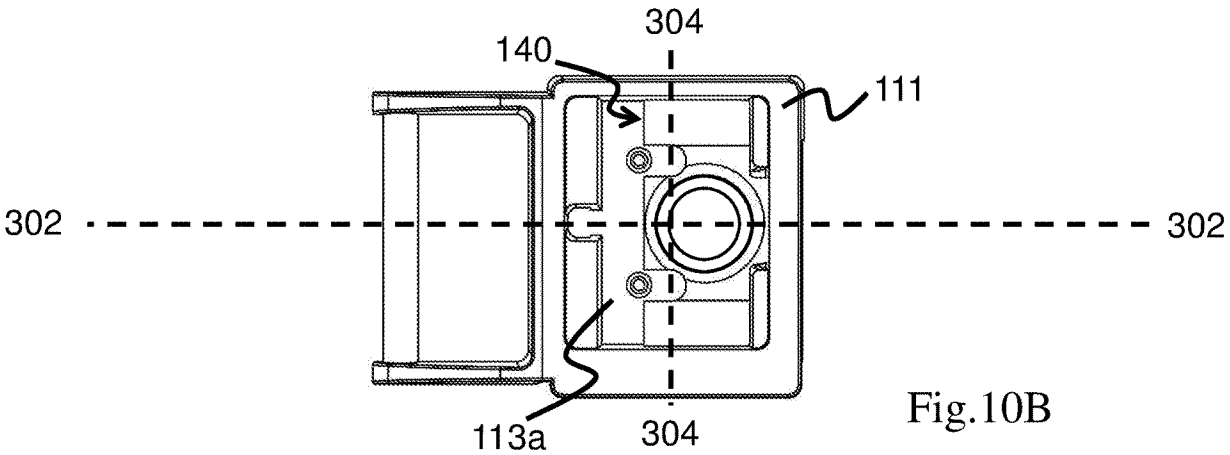
Figure 11A:
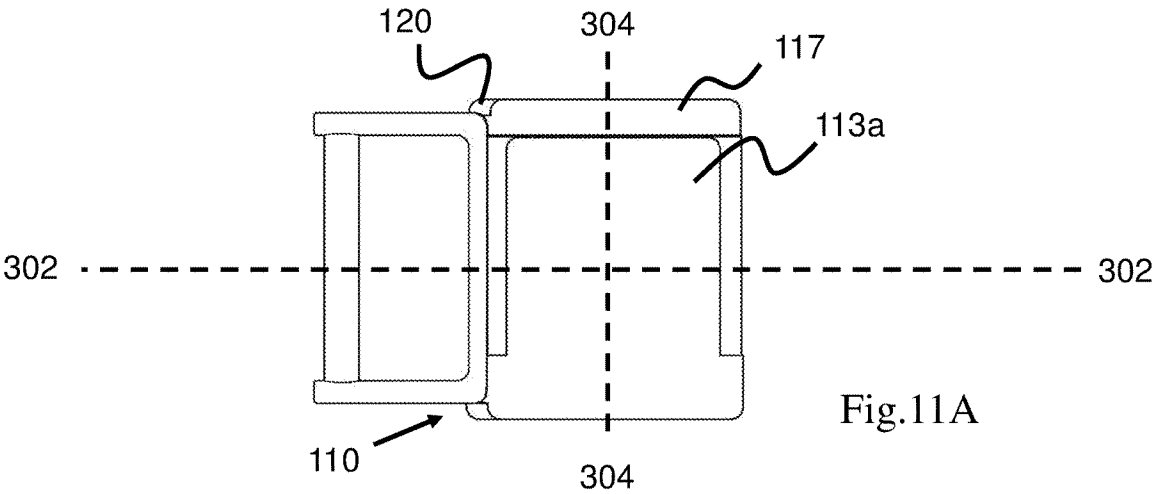
FIGS. 11A and 11B illustrate a bottom view of the buckle in unlocking position and locking position respectively according to one embodiment of the instant invention.
Figure 11B:
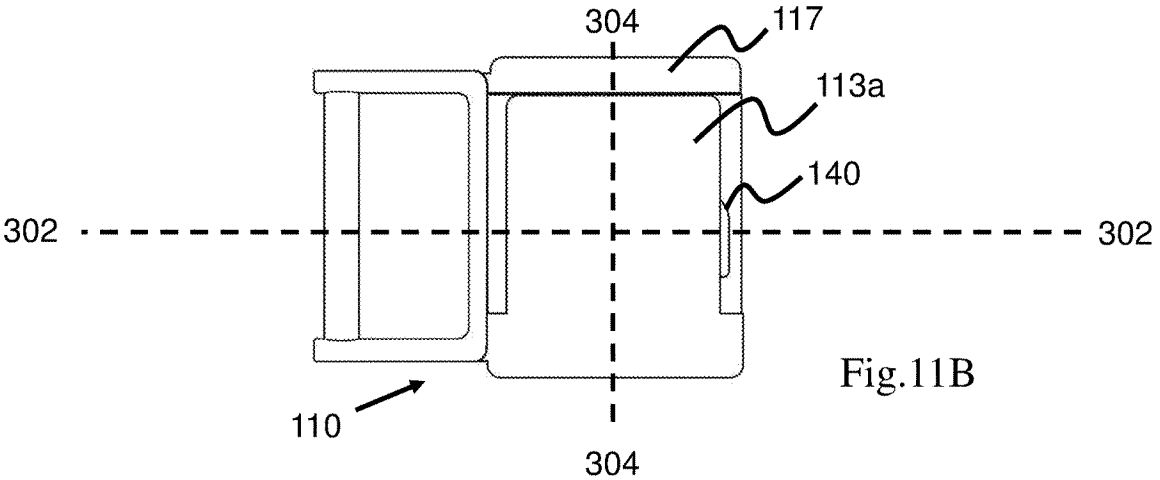

To disengage the male plate 100 from the female plate 200, a user first presses on the press member 120 and pulls the press member 120 away from the second end to the first end along the binding axis 302 such that the tongue 142 moves away from tongue receiving port 216 of the female plate 200, in which the male plate 100 switches from a locking position as shown in FIGS. 9B, 10B and 11B, into an unlocking position, as shown in FIGS. 9A, 10A and 11A. The spring provides control and support of the movement of the tongue 142 along the binding axis 302—when the user releases the press member 120, the resilient action of the spring would drive the tongue 142 to move from the first end to the second end along the binding axis 302.

Upon pulling the press member 120 as afore-described, the user then slides the male plate 100 from the second end to the first end along the longitudinal axis 304 such that the flange 113*a* slides out of the first opening 202*a* and the second opening 202*b*. As a result, the male plate 100 is fully disengaged from the female plate 200 along both the binding axis and the longitudinal axis.

In a preferred embodiment, the male plate 100 can be coupled to or disengaged from the female plate 200 by a single-handed motion.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

What is claimed is:

1. A buckle comprising:

a male plate that includes:

an engagement member that includes:

a housing; and a rail that connects to a bottom of the housing;

a tongue member that movably disposes within the housing of the engagement member along a binding axis and includes:

a flat end that disposes on a first end along the binding axis;

a trapezoidal shaped tongue that disposes on a second end along the binding axis and extends through a tongue opening of the housing; and a washer holder that disposes at a center of the tongue member;

a support member that disposes on top of the tongue member along a transverse axis and secures to the engagement member; and a press member that disposes on top of the support member along the transverse axis and couples to the tongue member;

a female plate that includes:

a base that opens at a first end along a longitudinal axis, and that includes:

a flange arm that disposes on a second end along the binding axis;

a hook arm that disposes on a first end along the binding axis; and a sidewall that disposes on a second end along the longitudinal axis, wherein a slant end of the tongue of the male plate is complementary to a slant portion of the hook arm of the female plate, and when the male plate approaches the female plate along the longitudinal axis, the slant end can smoothly engage with the slant portion and so the tongue can swiftly enter a tongue receiving port of the hook arm and be securely locked within the tongue receiving port, such that the male plate can securely couple to the female plate in a locking position;

wherein at least one spring that disposes within the housing, and that abuts against a spring sidewall of the engagement member along the binding axis, and that abuts against a spring support of the tongue member along the transverse axis; and wherein a resilient action of the spring drives the tongue member to move within the housing along the binding axis.

2. The buckle of claim 1, wherein the female plate further comprises:

a first opening that is provided between the hook arm and the base;

a second opening that is provided between the flange arm and the base;

wherein the first opening is complementary to an inverse-L-shaped side of the rail of the male plate and the second opening is complementary to an opposite L-shaped side of the rail of the male plate, and when the male plate approaches the female plate along the longitudinal axis, the first opening and the second opening can receive the rail, such that the male plate can securely couple to the female plate in the locking position.

3. The buckle of claim 1, further comprising:

a first fastener that abuts against the housing of the male plate and that connects to a first end of a belt;

a second fastener that abuts against the hook arm of the female plate and that connects to a second end of a belt;

wherein when the male plate securely couples to the female plate in the locking position, the buckle binds the first end of the belt and the second end of the belt together.

4. A buckle comprising:

a male plate that includes:

an engagement member that includes:

a housing; and a rail that connects to a bottom of the housing;

a tongue member that movably disposes within the housing of the engagement member along a binding axis and includes:

a flat end that disposes on a first end along the binding axis;

a trapezoidal shaped tongue that disposes on a second end along the binding axis and extends through a tongue opening of the housing; and a washer holder that disposes at a center of the tongue member;

a support member that disposes on top of the tongue member along a transverse axis and secures to the engagement member; and a press member that disposes on top of the support member along the transverse axis and couples to the tongue member, wherein the press member includes a press plate; and a press protrusion that disposes on the press plate, wherein the press protrusion inserts into the washer holder of the tongue member via a T-shaped opening of the support member, such that the press member can securely couple to the tongue member; and a female plate that includes:

a base that opens at a first end along the longitudinal axis, and that includes:

a flange arm that disposes on a second end along the binding axis;

a hook arm that disposes on a first end along the binding axis; and a sidewall that disposes on a second end along the longitudinal axis, wherein a slant end of the tongue of the male plate is complementary to a slant portion of the hook arm of the female plate, and when the male plate approaches the female plate along the longitudinal axis, the slant end can smoothly engage with the slant portion and so the tongue can swiftly enter a tongue receiving port of the hook arm and be securely locked within the tongue receiving port, such that the male plate can securely couple to the female plate in a locking position.

5. A buckle comprising:

a male plate that includes:

an engagement member that includes:

a housing; and a rail that connects to a bottom of the housing;

a tongue member that movably disposes within the housing of the engagement member along a binding axis and includes:

a flat end that disposes on a first end along the binding axis;

a trapezoidal shaped tongue that disposes on a second end along the binding axis and extends through a tongue opening of the housing; and a washer holder that disposes at a center of the tongue member;

a support member that disposes on top of the tongue member along a transverse axis and secures to the engagement member; and a press member that disposes on top of the support member along the transverse axis and couples to the tongue member;

a female plate that includes:

a base that opens at a first end along the longitudinal axis, and that includes:

a flange arm that disposes on a second end along the binding axis;

a hook arm that disposes on a first end along the binding axis; and a sidewall that disposes on a second end along the longitudinal axis, wherein a slant end of the tongue of the male plate is complementary to a slant portion of the hook arm of the female plate, and when the male plate approaches the female plate along the longitudinal axis, the slant end can smoothly engage with the slant portion and so the tongue can swiftly enter a tongue receiving port of the hook arm and be securely locked within the tongue receiving port, such that the male plate can securely couple to the female plate in a locking position; and at least one cylindrically shaped pillar that disposes within the housing, wherein the support member secures to the engagement member through a coupling between the pillar and a pillar opening of the support member.

* * * * *